United States Patent [19]

Williams

[11] 4,299,554

[45] Nov. 10, 1981

[54] AUTOMATIC VENT DAMPER AND FUEL VALVE CONTROL

[75] Inventor: Don W. Williams, P.O. Box 185, Van Wert, Ohio 45891

[73] Assignee: H & M Distributors, Inc., Fort Wayne, Ind.

[21] Appl. No.: 90,491

[22] Filed: Nov. 1, 1979

[51] Int. Cl.[3] ..... F23N 3/00

[52] U.S. Cl. ..... 431/16; 431/20; 431/76

[58] Field of Search ..... 431/16, 20, 22; 236/1 G

[56] References Cited

U.S. PATENT DOCUMENTS

| | | | |
|---|---|---|---|
| 3,074,644 | 1/1963 | Geniesse | 431/76 |
| 4,189,296 | 2/1980 | Hayes | 431/20 |
| 4,239,477 | 12/1980 | Hayes | 431/20 |

*Primary Examiner*—Carroll B. Dority, Jr.
*Attorney, Agent, or Firm*—Gust, Irish, Jeffers & Hoffman

[57] ABSTRACT

An automatic vent damper and fuel valve control for a fluid fuel-fired furnace including an electrically-operated valve in the fuel line, a normally-open damper in the furnace vent having electrically-operated means for closing the damper, and a thermostat for sensing the temperature in the space being heated. A Hall-effect generator is employed for sensing the positions of the damper and for respectively providing signals in response thereto. A gas detector is provided for sensing the presence of hydrocarbon-containing gas in the region of the draft hood and vent of the furnace and for providing a gas-present signal in response thereto. A control is provided for the valve responsive to both the damper-open signal and the thermostat calling for heat to energize the valve to open the same, the valve control de-energizing the valve to close the same in response to the thermostat calling for termination of heating, or the damper-closed signal, or the gas-present signal. A control is provided for the damper closing means for energizing the same after a predetermined time delay responsive to the thermostat calling for termination of heating, the damper control de-energizing the damper closing means in response to the gas-present signal or the thermostat calling for heat.

12 Claims, 5 Drawing Figures

38
38
54
50
52
58
56
74
76
100
A.
98
102
78
96
80
108
108
170
172
B.
104
C.
198
88
114
D.
86
60
E.
174
72
92
F.
176
152
148
G.
178
132
90
196
H.
66
68
I.
180
140
62
142
112
144
64
J.
K.
186
190
L.
182
184
208
M.
188
200
N.
192
210
206
194
204
202
168
212
214
O.
216
218
DAMPER CLOSED
P.
220
222
DAMPER OPEN
Q.

DAMPER SOLENOID
GAS VALVE
24
30
34
116
120
44
110
82
106
84
94
70
118
130
150
124
122
146
158
162
128
136
138
230
154
164
134
252
156
160
100
126
268
270
264
260
256
276
258
ALARM
246
250
248
226
228
242
224
244
266
274
238
272
254
234
262
232
240
236
32
A.
B.
C.
D.
E.
F.
G.
H.
I.
J.
K.
L.
M.
N.
O.
P.
Q.

AUTOMATIC VENT DAMPER AND FUEL VALVE CONTROL

BACKGROUND OF THE INVENTION

1. Field of the Invention

This invention relates generally to furnace controls, and more particularly to an automatic vent and fuel valve control for a fluid fuel-fired furnace.

2. Description of the Prior Art

Conventional, domestic gas-fired furnaces comprise a combustion chamber communicating with a draft hood which, in turn, communicates with a vent or stack. A heat exchanger is typically located above the combustion chamber, and a gas line having a solenoid-operated valve therein extends into the combustion chamber and terminates in a nozzle or burner. In hot air furnaces, a blower is provided for circulating air through the heat exchanger.

In conventional control systems for furnaces of the hot air type, a thermostat sensing a predetermined lower temperature in the space being heated closes its contacts to energize the gas valve. A fan and limit switch senses the temperature in the heat exchanger and when the temperature therein has risen to a lower predetermined level, the fan and limit switch energizes the blower. When the temperature in the space being heated rises to a predetermined higher value, the thermostat opens at the contacts thereby de-energizing the gas valve; however, the blower continues to operate for a period of time to extract heat from the heat exchanger and it is then de-energized by the fan and limit switch. The fan and limit switch will also deenergize the gas valve if the temperature of the heat exchanger reaches a predetermined higher limit, the gas valve remaining closed until the blower has cooled the heat exchanger down to the lower limit.

In the past, no damper was provided in the furnace vent or stack and it will readily be seen that a substantial amount of heat was lost through the stack after the burner was shut-down. Automatically operated vent dampers have been provided to closeoff the vent pipe or stack after the burner has been shut-down thus retaining some of the heat in the heat exchanger which normally would escape through the vent and flue as lost heat. Such prior automatic vent dampers have been of the normally-open type, i.e., biased to the open position by a weight, and have been closed by a motor or solenoid in response to shuttingdown of the burner. Various cam and microswitch arrangements have been employed for detecting the damper position; however, such mechanical arrangements are subject to mechanical wear and temperature extremes.

Present automatic damper control systems known to the present applicant do not provide for opening the damper in response to sensing the presence of hydrocarbon-containing gas in the vent or draft hood, such as would be caused by a downdraft in the flue which tends to blow carbon monoxide back into the dwelling, or the sensing of raw gas in the event that the burner fails to light or if the flame is accidently extinguished. It is therefore desirable to provide an automatic vent damper and valve control system which will sense the presence of hydrocarbon-containing gas, close the gas valve and open the damper in response thereto.

It is further desirable that such a control system close the damper after a predetermined time delay following shuttingdown the burner in order to permit the escape of excess hydrocarbon through the flue and also to accommodate certain types of delayed-closing gas valves.

SUMMARY OF THE INVENTION

The automatic damper and fuel valve control system of the invention is incorporated in a fluid fuel-fired furnace which includes a combustion chamber, a draft hood terminating in a exhaust stack, a fluid fuel line terminating in a burner in the combustion chamber, and electrically-operated valve means for coupling the fuel line to the source of fluid fuel under pressure. Normally-open damper means is provided in the stack for closing the same, electrically-operated means is provided for closing the damper means, and means are provided for sensing the temperature in the space being heated by the furnace and having a first condition calling for heat at a selected lower temperature and a second condition calling for termination of heating at a selected higher temperature.

In its broader aspects, the control system of the invention provides means for sensing the position of the damper means and for respectively providing damper-open and damper-closed signals in response thereto. Means are provided for sensing the presence of a hydrocarbon-containing gas in the region of the draft hood and stack and for providing a gas-present signal in response thereto. Valve control means is provided adapted to be coupled to the valve means and responsive to both the damper-open signal and to the first condition of the temperature sensing means for energizing the valve means to open the same, the valve control means de-energizing the valve means to close the same in response to any one of the second condition of the temperature sensing means, the gas-present signal, and the damper-closed signal. Damper control means is provided adapted to be coupled to the damper closing means and responsive to the second condition of the temperature sensing means for energizing the damper closing means after a predetermined time delay, the damper control means de-energizing the damper closing means in response to any one of the gas-present signal and the first condition of the thermostat means.

It is accordingly an object of the invention to provide an improved automatic vent damper and valve control system for a fluid fuel-fired furnace.

Another object of the invention is to provide an improved automatic vent damper and valve control system for a fluid fuel-fired furnace which senses the presence of a hydrocarboncontaining gas in the draft hood or stack and opens the damper and de-energizes the valve in response thereto.

A further object of the invention is to provide an improved automatic vent damper and valve control system for a fluid fuel-fired furnace wherein energizing the fuel valve to open the same can be accomplished only if the damper is open and the thermostat is calling for heat.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
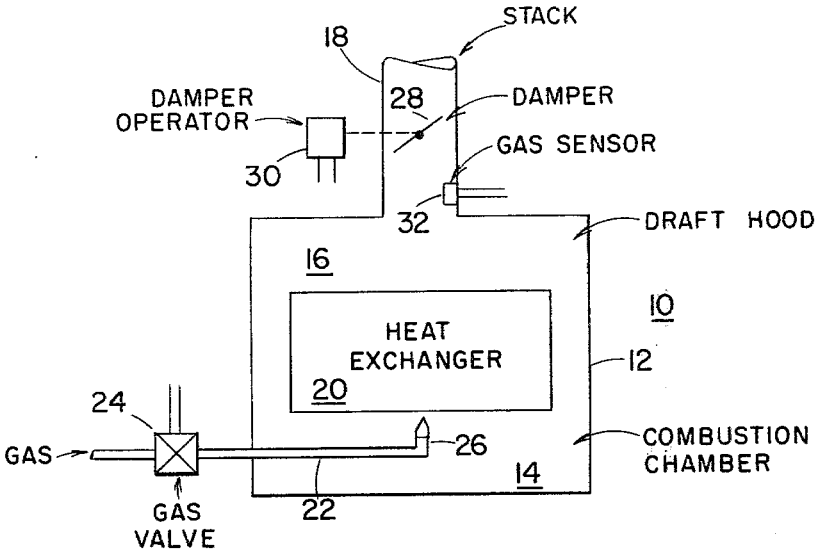
FIG. 1 is a schematic illustration of a conventional gas furnace having a vent damper and showing the location of the gas sensor employed in the invention.

Referring now to FIG. 1 of the drawing, a conventional gas-fired furnace is shown, generally indicated at 10, including an enclosing case 12 having combustion chamber 14 in its lower region communicating with draft hood 16 which, in turn, communicates with stack or vent 18. Heat exchanger 20 is disposed in heat-transfer relationship with combustion chamber 14 and, in the case of a hot air furnace, has a blower (not shown) communicating therewith for circulating air therethrough. Gas line 22 having solenoid-operated gas valve 24 therein exteriorly of furnace 10 extends into combustion chamber 14 and terminates in burner head 26.

Normally open vent damper 28, to be hereinafter more fully described, is positioned in vent 18 and is actuated to its closed position by a solenoid operator 30. Gas sensor 32 employed in the control of the invention may be positioned in stack 18, as shown, or in draft hood 16.

Figure 2:
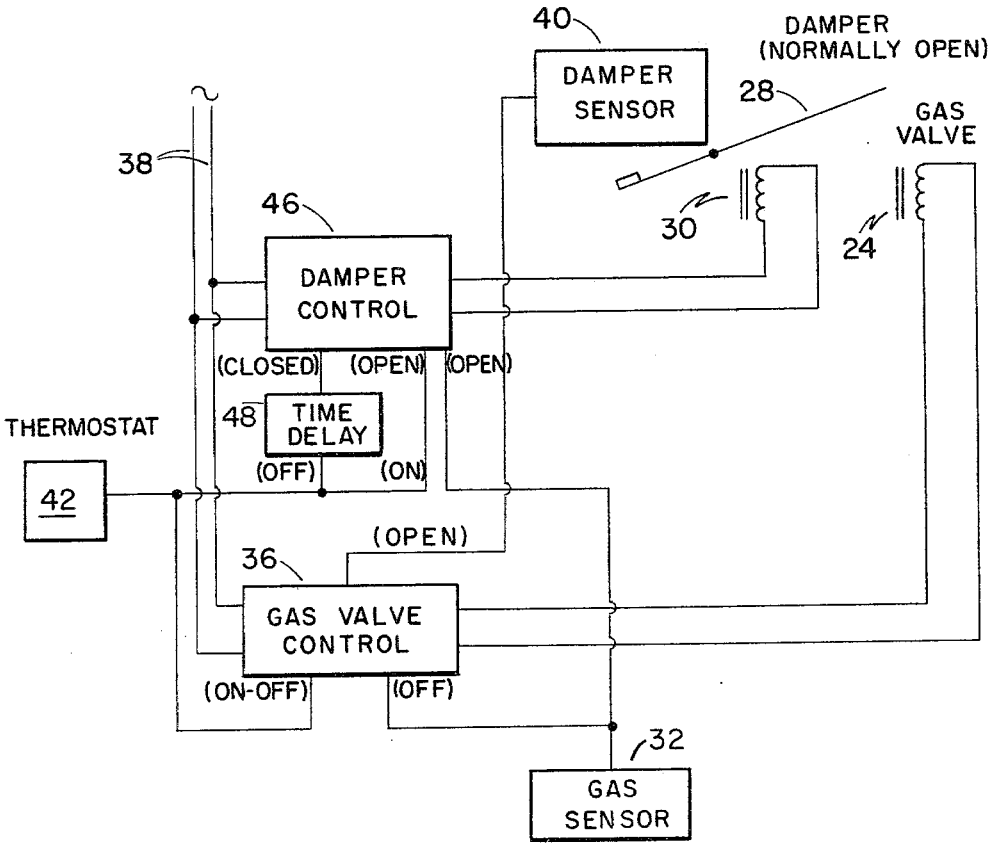
FIG. 2 is a greatly simplified functional block diagram showing the automatic vent damper and valve control system of the invention.

Referring now briefly to FIG. 2, solenoid coil 34 of gas valve 24 is coupled to gas valve control circuit 36 which, in turn, is connected to source 38 of suitable energizing potential. Damper sensor 40 senses the position of damper 28 and provides damper-open and damper-closed signals in response thereto. Damper sensor 40 is coupled to gas control valve 36 along with gas sensor 32 and thermostat 42. As will be hereinafter more fully described, gas valve control 36 energizes gas valve solenoid 34 to open gas valve 24 only in response to both a damper-open signal from damper sensor 40 and thermostat 42 calling for heat, i.e., an "ON" signal. Gas valve control 36 will de-energize gas valve solenoid 34 in response to a gas-present signal from gas senor 32, or thermostat 42 calling for termination of heat, i.e., an "OFF" signal, or a damper-closed signal from damper sensor 40 in the event of some inadvertent closing of damper 28.

Damper-closing solenoid coil 44 of damper operator 30 is coupled to damper control 46 which, in turn, is coupled to source 38 of energizing potential. Thermostat 42 is coupled to damper control 46 by time delay circuit 48 which delays the "OFF" signal from thermostat 42 by a predetermined time delay interval thereby to energize damper closing solenoid coil 44 a predetermined time after thermostat 42 has called for termination of heating ("OFF"). Damper closing solenoid coil 44 is de-energized thereby to open damper 28 in response to an "ON" signal from thermostat 42. Gas sensor 32 is also coupled to damper control 46 which de-energizes damper closing solenoid coil 44 to open damper 28 in response to a gas-present signal.

It is to be understood that FIG. 2 illustrates the functions performed by the improved automatic damper and valve control system of the invention, and is not intended to show the actual circuitry employed.

Figure 3A:
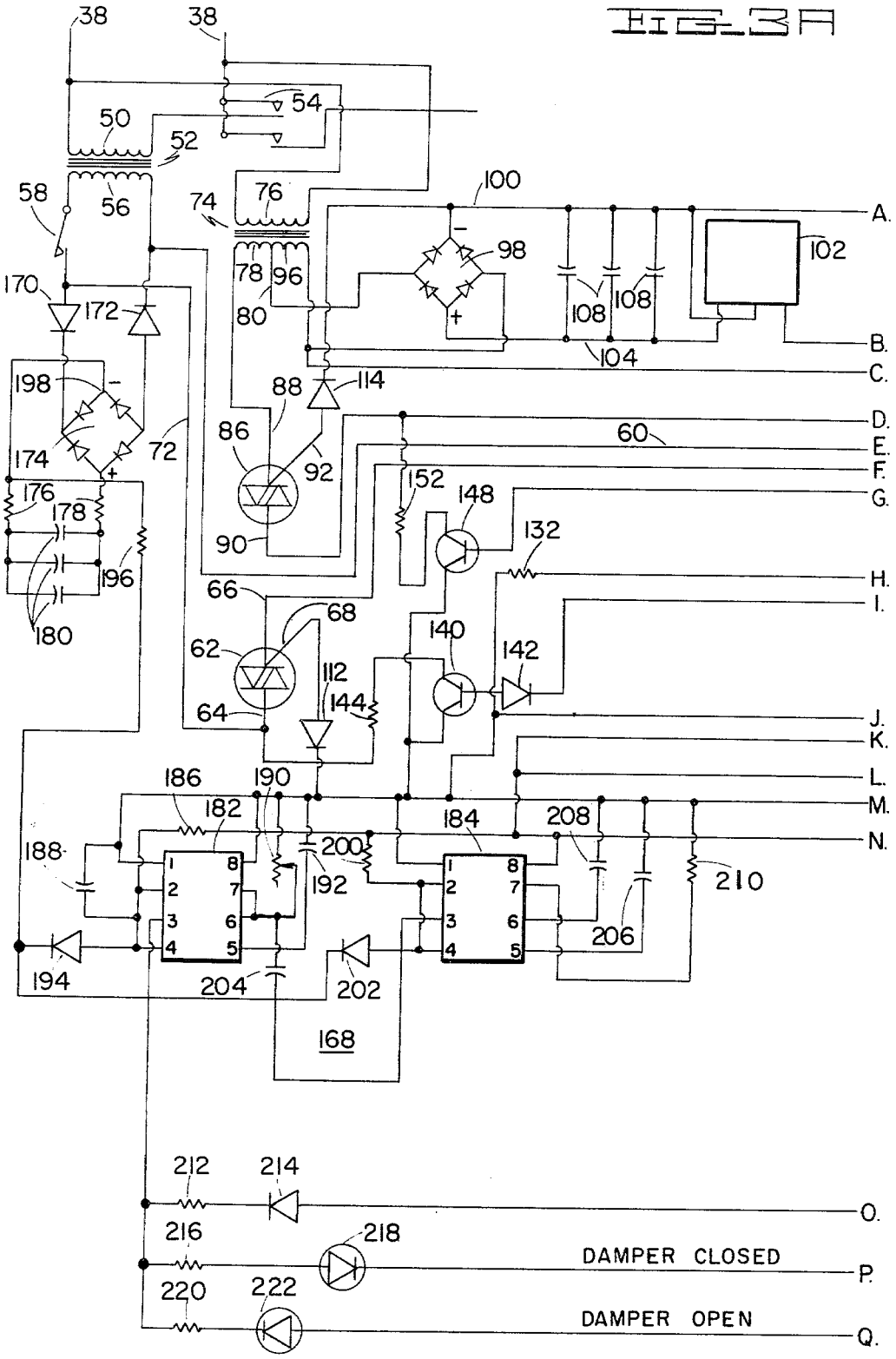
FIGS. 3A and 3B are a schematic illustration of the automatic vent damper and valve control system of the invention.
Figure 3B:
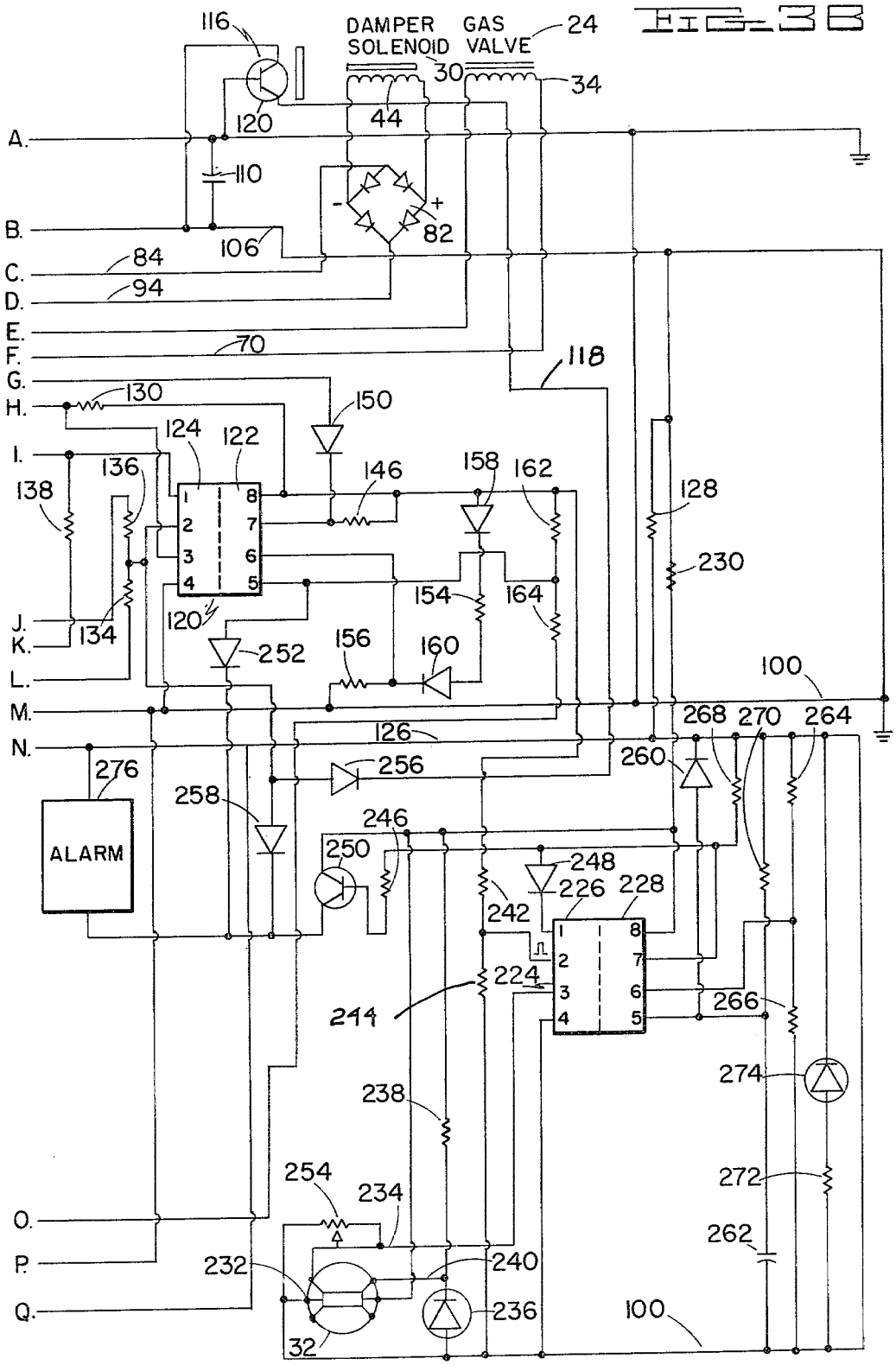

Referring now to FIG. 3, source 38, which may be conventional single phase, 120-volts, 60-Hertz, is coupled to primary winding 50 of conventional furnace control transformer 52 through conventional fan and limit switch contacts 54. The fan and limit switch connections to the blower, being conventional, are not shown. Transformer 52 steps-down the line voltage to an appropriate lower voltage across secondary winding 56, such as 25-volts. Conventional thermostat 58 is coupled in series with secondary winding 56 of transformer 52. Line 60 connects one side of secondary winding 56 to solenoid coil 34 of gas valve 24. Conventional triac 62 is provided having line element 64, load element 66 and gate element 68. Conductor 70 connects the other side of gas valve solenoid coil 34 to load element 66 of triac 62, and conductor 72 connects line element 64 to the other side of secondary winding 56 of transformer 52 through thermostat 58. It will now be seen that line and load elements 64, 66 of triac 62 and thermostat 58 couple gas valve solenoid coil 34 across secondary winding 56 of transformer 52.

In order to prevent over-loading of the usual furnace control transformer 52, another control transformer 74 is provided having it primary winding 76 coupled to source 38. Transformer 74 steps-down the voltage of source 38 to an appropriate lower voltage across secondary winding 78, such as 25-volts. Secondary winding 78 of transformer 74 is center-tapped, as at 80. Damper closing solenoid coil 44 of damper operator 30 is coupled across the output terminals of suitable bridge rectifier 82. Conductor 84 connects one input terminal of rectifier 82 to one side of secondary winding 78 of transformer 74. Another triac 86 is provided having line element 88, load element 90 and gate element 92. Conductor 94 connects the input terminal of rectifier 82 to load element 90 of triac 86 and line element 88 is connected to the other side of secondary winding 78 of transformer 74. It will now be seen that line and load elements 88, 90 of triac 86 couple bridge rectifier 82 across secondary winding 78 of transformer 74. It will be understood that traics 62, 86 are bi-directional, gate controlled switches.

Center-tapped section 96 of secondary winding 78 of transformer 74 is coupled across the input terminals of bridge rectifier 98. The negative output terminal of rectifier 98 is connected to ground buss 100 and the positive output terminal is connected to one side of voltage regulator 102 by conductor 104. Negative buss 100 is connected to voltage regulator 102 and the positive output terminal of voltage regulator 102 is connected to B+ buss 106. Filter capacitors 108 are connected across ground buss 100 and positive buss 104, and filter capacitor 110 is coupled across ground buss 100 and B+ buss 106. Gate element 68 of triac 62 is coupled to ground buss 100 by diode 112 and gate element 92 of triac 86 is coupled to ground buss 100 by diode 114.

Figure 4:
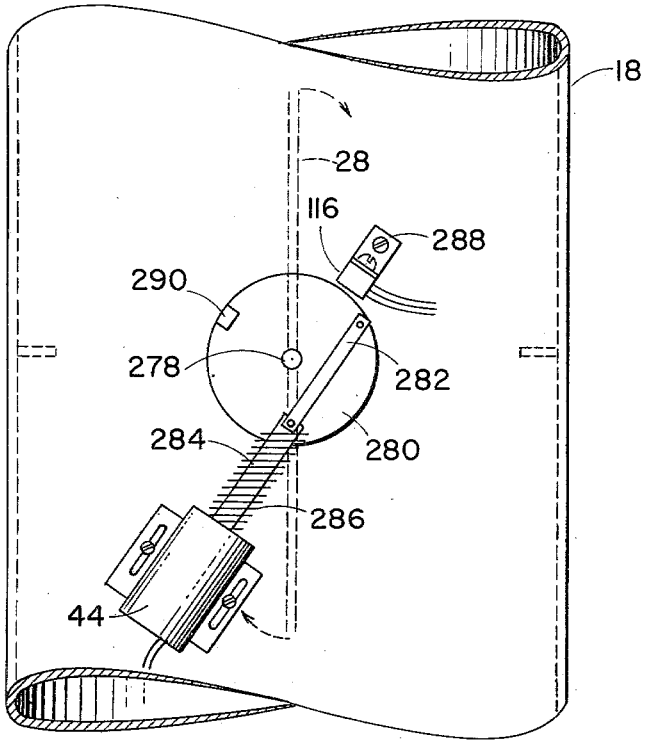
FIG. 4 is a side elavational view of a section of a furnace stack equipped with a solenoid-operated damper usable with the control system of the invention.

In the preferred embodiment, damper sensor 40 comprises a fixed Hall-effect generator 116 cooperating with a magnet mounted on shaft 278 of damper 28 (FIG. 4). Hall-effect generator 116 takes the form of an open collector transistor having its base connected to ground buss 100 and one collector connected to B+ buss 106.

Damper open and closed signal line 118 is coupled to the other collector 120 of Hall-effect generator 116.

Dual operational amplifier circuit 120, connected as two separate voltage comparators is provided, pins 1, 2, 3 and 4 being associated with voltage comparator 124 and pins 5, 6, 7 and 8 being associated with voltage comparator 122. Pin 1 is the output terminal, pin 2 is the inverting input and pin 3 is the non-inverting input of voltage comparator 124. Pin 5 is the non-inverting input, pin 6 is the inverting input and pin 7 is the output terminal of voltage comparator 122. Pin 4 is the common negative terminal of voltage comparators 122, 124 and is connected to ground buss 100, and pin 8 is the common positive terminal. Buss 106 is connected to VCC buss 126 by resistor 128, and to ground buss 100 by serially connected resistors 130, 132, resistors 128, 130, 132 thus comprising a voltage divider with plus voltage pin 8 of voltage comparators 122, 124 being connected to the mid point between resistors 128 and 130 thus maintaining the voltage on VCC buss 126 at about 6.5 volts DC.

The mid-point between resistors 130, 132 is coupled to non-inverting input pin 3 of voltage comparator 124 and inverting input pin 2 is coupled to the mid-point between resistors 134, 136 serially coupled across ground buss 100 and VCC buss 126. Output pin 1 of voltage comparator 124 is connected to VCC buss 126 by resistor 138 and to the base of transistor 140 by diode 142. The emitter of transistor 140 is connected to ground buss 100 and the collector is connected to line element 64 of triac 62 by resistor 144.

Output pin 7 of voltage comparator 122 is connected to VCC buss 126 by resistor 146 and to the base of transistor 148 by diode 150. The emitter of transistor 148 is connected to ground buss 100 and the collector is connected to load element 90 of triac 86 by resistor 152. Resistors 154, 156 are serially connected with diodes 158, 160 across VCC buss 126 and ground buss 100 thus forming a voltage divider with its mid-point connected to inverting input pin 6 of voltage comparator 122. Inverting input pin 5 of voltage comparator 122 is connected to the midpoint between serially connected resistors 162, 164, resistor 162 being connected to VCC buss 126 and resistor 164 being connected to timer circuitry 168 as will be hereinafter described.

Diodes 170, 172 connect the input terminals of bridge rectifier 174 across thermostat 58 and secondary winding 56 of transformer 52. Resistors 176, 178 connect the output terminals of rectifier 174 across capacitors 180. Timer circuitry 168 comprises timer 182 and monostable multivibrator 184. Pin 1 of timer 182 is connected to ground buss 100 and pin 8 is connected to VCC buss 126. Resistor 186 connects trigger pin 2 and reset pin 4 of timer 182 to VCC buss 126, and capacitor 188 connects trigger pin 2 and reset pin 4 to ground buss 100. Threshold pin 6 and discharge pin 7 of timer 182 are connected to the sliding element of rheostat 190. Capacitor 192 connects control voltage pin 5 to ground buss 100. Diode 194 and resistor 196 serially connect trigger pin 2 and reset pin 4 of timer and bistable multivibrator 182 to negative output terminal 198 of rectifier 174.

Pin 1 and pin 8 of monostable multivibrator 184 are connected to ground buss 100 and VCC bus 126, respectively. Resistor 200 connects VCC buss 126 to trigger and reset pins 4. Diode 202 and resistor 196 connect the negative output terminal 198 of rectifier 174 to trigger and reset pins 2, 4 of monostable multivibrator 184. Capacitor 204 connects output pin 3 of monostable multivibrator 184 to threshold and discharge pins 6, 7 of timer 182. Capacitors 206, 208 connect control voltage and threshold pins 5, 6, respectively, of monostable multivibrator 184 to ground buss 100, and resistor 210 connects discharge pin 7 to ground buss 100.

It will be understood that components 182, 184 are preferably identical integrated circuits, one connected to function as multivibrator 182 and the other connected to function as monostable or one-shot multivibrator 184.

Resistor 212 and diode 214 serially connect output pin 3 of bistable multivibrator 182 to voltage divider 162, 164. Resistor 216 and LED 218 serially connect output pin 3 of bistable multivibrator 182 to ground buss 100, and resistor 220 and LED 222 serially connect output pin 3 to VCC buss 126.

Another dual operational amplifier 224 arranged to provide two voltage comparators 226, 228 is provided with common pin 4 connected to ground buss 100 and pin 8 connected to B+ buss 106 by resistor 230. Gas detector 32 has one terminal 232 connected to ground buss 100 and its output terminal 234 connected to non-inverting input pin 3 of voltage comparator 226. Zener diode 236 is connected between ground buss 100 and common pin 8 by resistor 238, zener diode 236 being connected across heater terminal 240 of gas detector 32 in order to maintain a constant voltage thereacross. Resistors 242, 244 are serially connected across ground buss 100 and VCC buss 126 and have their midpoint connected to inverting input pin 2 of voltage comparator 226. Resistor 246 and diode 248 serially connect output pin 1 of voltage comparator 226 to the base of transistor 250. The emitter of transistor 250 is connected to common pin 8 of dual operational amplifier 224 and the collector is connected to non-inverting input pin 5 of voltage comparator 122 by diode 252. Potentiometer 254 connected across ground buss 100 and output terminal 234 of gas detector 32 adjusts the sensitivity of the gas detector.

Emitter 120 of Hall-effect generator 116 is connected by conductor 118 and diode 256 to inverting input pin 2 of voltage comparator 124. Diode 258 connects the collector transistor 250 to inverting input pin 2 of voltage comparator 124.

Diode 260 connects VCC buss 126 to non-inverting input pin 5 of voltage comparator 228, which is also connected to ground buss 100 by capacitor 262. Resistors 264, 266 are connected across VCC buss 126 and ground buss 100 and have their midpoint connected to inverting input pin 6 of voltage comparator 228. Output pin 7 of voltage comparator 228 is connected to the base of transistor 250 by resistor 246, and is also connected to VCC buss 126 by resistor 268. Non-inverting input pin 5 of voltage comparator 228 is also connected to VCC buss 126 by resistor 270. Resistor 272 and LED 274 serially connect ground buss 100 to VCC buss 126 to provide an indication when the control circuit is energized. Audible alarm device 276 connects the collector of transistor 250 to VCC buss 126.

Referring now to FIG. 4, a section of vent pipe 18 is shown with the damper 28 mounted therein by means of pivot pin 278. Disc 280 is secured to pivot pin 278 exteriorly of vent pipe 18 and is rotated from the damper-open position shown in dashed lnes to the damper-closed position by means of link 282 connected to armature 284 of solenoid 44. Spring 286 returns armature 284, link 282, disc 280 and damper 28 to the damper-open position. Hall-effect generator 116 is mounted on the exterior of vent pipe 18 by suitable bracket 288 adjacent the periphery of disc 280, and magnet 290 is mounted on disc 280 adjacent its periphery to cooperate with Hall-effect generator 116 when damper 28 is in the closed position. It will be understood that when magnet 280 is rotated away from Hall-effect generator 116, the output thereof is high whereas, when magnet 290 is rotated into alignment with Hall-effect generator 116, the output is low.

OPERATION

Thermostat OFF—Damper Closed—Gas OFF

It will first be assumed that transformers 52, 74 are energized and thermostat 58 is OFF. Under these circumstances, no voltage is applied to rectifier 174 nor to trigger and re-set pins 2, 4 of bistable multivibrator 182 so that the output on pin 3 is high, thus energizing the damper-open LED 218. The voltage drop across the voltage divider comprising resistors 154, 156 is such that inverting input pin 6 of voltage comparator 122 is low. With the output pin 3 of bistable multivibrator 182 being high, no current will flow in the circuit comprising voltage divider 162, 164, diode 214 and resistor 212 and thus, the voltage applied to non-inverting input pin 5 of voltage comparator 122 will be essentially that of VCC buss 126, i.e., high. Output pin 7 of voltage comparator 122 is thus driven low to turn-on transistor 148 which in turn gates triac 86 ON thereby to energize damper-closing solenoid coil 44 so as to close damper 28. With damper 28 closed, the output of Hall-effect generator 116 is low and thus, by virtue of the resistance values employed in the respective voltage dividers, the potential applied to inverting input pin 2 of voltage comparator 124 is high with respect to the potential applied to non-inverting input pin 3 and thus, output pin 1 of voltage comparator 124 is driven high thus turning OFF transistor 140; gas valve solenoid 34 was previously de-energized due to opening of thermostat 58.

It will be observed that following the time delay in closing as will be hereinafter more fully described, damper 28 will remain closed so long as thermostat 58 is open and control transformer 74 is energized. It will be further observed that, if for any reason, control transformer 74 is de-energized, damper solenoid coil 44 will be de-energized thus permitting damper 28 to open. Further, so long as damper 28 is closed, the closing of thermostat 58 will not result in energization of gas valve solenoid 34 by reason of transistor 140 being de-energized to gate triac 62 OFF as above described. Further, as will be hereinafter described, the appearance of a gas-present signal, when damper 20 is closed, will drive output pin 1 of voltage comparator 226 low thus causing current to flow through resistor 162, diode 252 and transistor 250. Resistor 162 has a high value, for example, one megoham, and thus, the current flow therethrough caused by a gas-present signal will cause the potential applied to non-inverting input pin 5 of voltage comparator 122 to go low thus causing the potential output pin 7 of voltage comparator 122 to high so as to turn-off transistor 148 to gate triac 86 OFF thereby to de-energize damper solenoid coil 44 to open damper 28.

As will be hereinafter described, with thermostat 58 closed, output pin 3 of bistable multivibrator 182 is low with the result that triac 62 is gated ON to energize the gas valve solenoid 34 and triac 86 is gated OFF to de-energize damper solenoid 44 so as to open damper 28. When thermostat 58 opens, capacitors 180 discharge thus applying a negative-going pulse to trigger and reset pins 2, 4 of bistable multivibrator 182 and mono-stable multivibrator 184. This initiates the one-shot operation of mono-stable multivibrator 184 which, after a predetermined time delay determined by rheostat 110, applies a pulse to threshold and discharge pins 6, 7 of bistable multivibrators 182 thus causing output pin 3 to go high, thereby gating triac 86 ON to energize damper closing solenoid 44 to close damper 28, as above-described.

Thermostat ON—Damper Open—Gas ON

With thermostat 58 closed, trigger and reset pins 2, 4 of bistable multivibrators 182 are low and output pin 3 is low thus driving output pin 7 of voltage comparator 122 high, as abovedescribed, thereby to turn transistor 148 OFF so as to gate triac 86 OFF thereby to de-energize damper solenoid coil 44 to open damper 28 with the result that the output signal from Hall-effect generator 116 in line 118 goes high. This terminates current flow through diode 256 thereby causing the potential applied to inverting input pin 2 of voltage comparator 124 by voltage divider 134, 136 to go low with respect to the potential applied to non-inverting input pin 3 by voltage divider 130, 132, thus causing output pin 1 to go low to turn-on transistor 140 so as to gate triac 62 ON, thus energizing gas valve solenoid coil 34. With output pin 3 of bistable multivibrator 182 now low, damper-open LED 222 is energized.

Gas Present

When gas detector 32 senses the presence of hydrocarboncontaining gas, the potential applied to non-inverting input pin 3 of voltage comparator 226 goes high with respect to the potential applied to inverting input pin 2 by voltage divider 242, 244 thus causing output pin 1 to go high to turn-on transistor 250 which causes current to flow through diodes 252 and 258 driving inverting input pin 2 of voltage comparator 124 low and non-inverting input pin 5 of voltage comparator 122 low thereby to drive output pins 1 and 7 high to turn-off transistors 142 and 148 which gate triacs 62, 68 OFF thus de-energizing gas solenoid coil 34 and damper solenoid closing coil 44. Conduction of transistor 250 also energizes the alarm 276.

Gas detector 32 includes a heater element which is heated in response to the presence of hydrocarbon-containing gas and thus, the output of output pin 1 of voltage comparator 226 will be high until the heater warms up. To accommodate this delay, voltage comparator 228 is used as a delay circuit to hold output pin 1 of voltage comparator 226 low until the filament in gas detector 32 is up to temperature. This is accomplished by means of resistor 270 which has a high value, such as 1.5 megohms connected to non-inverting input pin 5 of voltage comparator 228 which holds the potential applied to that pin low with respect to the potential applied to inverting input pin 6 by the voltage divider 264, 266 thus holding the output pin 7 high.

In a physical embodiment of the invention, the following components and component values were employed:

Capacitors 108, 110—1000 mfd.
Dual operational amplifier 120—LM1458
Resistors 130, 132—100 K
Resistor 134—4.7 K
Resistor 135—6.8 K
Resistor 138—10 K
Resistor 144—100 ohms Resistor 146—10 K
Resistor 152—100 ohm
Resistor 154—4.7 K
Resistor 156—6.8 K
Resistor 162—1 Meg
Resistor 164—100 K
Resistors 176—100 ohm
Resistors 178—100 ohm
Capacitors 180—220 mfd.
Bistable multivibrator 182—Radio Shack RS555
Mono-stable multivibrator 184—Radio Shack R555
Resistor 186—10 K
Capacitor 188—220 mfd.
Rheostat 190—27 K tapered
Capacitor 192—0.01 mfd.
Resistor 196—10 K
Resistor 200—10 K
Capacitor 204—100 mfd
Capacitor 208—10 mfd.
Resistor 210—6.8 K
Resistor 212—47 ohm
Resistor 216—470 ohm
Resistor 220—470 ohm
Dual Operational Amplifier 224—LM3903
Resistor 238—39 ohm
Resistors 242, 244—6.8 K
Resistor 246—1 K
Resistor 264—2.2 K
Resistor 266—3.9 K
Resistor 268—2.2 K
Resistor 270—1.5 Meg.
Resistor 272—1 K
Gas detector 32—Figaro 812

While the invention described is in connection with gas-fired furnaces, it will be understood that it is equally applicable to oil-fired furnaces.

While there have been described above the principles of this invention in connection with specific apparatus, it is to be clearly understood that this description is made only by way of example and not as a limitation to the scope of the invention.

What is claimed is:

1. In a fluid fuel-fired furnace including a combustion chamber, a draft hood terminating in an exhaust stack, a fluid fuel line terminating in a burner in said combustion chamber, electrically-operated valve means for coupling said fuel line to a source of fluid fuel under pressure, normally-open damper means in said stack for closing the same, electrically-operated means for closing said damper means, means for sensing the temperature in the space being heated by said furnace and having a first condition calling for heat at a selected lower temperature and a second condition calling for termination of heating at a selected higher temperature, a control system for said damper means and valve means comprising: means for sensing the position of said damper means and for respectively providing damper-open and damper-closed signals in response thereto; means for sensing the presence of a hydrocarbon-containing gas in the region of said draft hood and stack and for providing a gas-present signal in response thereto; valve control means adapted to be coupled to said valve means and responsive to both said damper-open signal and to said first condition of said temperature sensing means for energizing said valve means to open the same, said valve control means de-energizing said valve means to close the same in response to any one of said second condition, said gas-present signal and said damper-closed signal; and damper control means adapted to be coupled to said damper closing means and responsive to said second condition for energizing said damper closing means after a predetermined time delay, said damper control means deenergizing said damper closing means in response to any one of said gas-present signal and said first condition of said thermostat means.

2. The control system of claim 1 further comprising timing means for providing a time-delay signal after said predetermined time delay; said timing means and said gas presence sensing means being coupled to said damper control means; said gas presence sensing means and said damper position sensing means being coupled to said gas valve control means.

3. The control system of claim 2 wherein each of said valve control means and damper control means includes a gatecontrolled switch device adapted respectively to couple said valve means and said damper closing means to a source of energizing potential, and a control circuit coupled to apply a gating signal to said switch device.

4. The control system of claim 3 wherein said temperature sensing means includes a thermostat having contacts adapted to couple said valve switch device to a source of energizing potential in response to said first condition.

5. The control system of claim 4 further comprising means adapted to couple said thermostat to said timing means, said timing means including means for providing a furnace-ON signal in response to said first condition, said timing means and said gas presence sensing means being coupled to said control circuits, said damper control circuit gating said damper switch device to energize said damper closing means in response to said time delay signal and gating said damper switch device to de-energize said damper closing means in response to said ON signal, said valve control circuit gating said valve switch device to energize said valve means in response to said ON signal.

6. The system of claim 5 wherein said position sensing means comprises a Hall-effect generator.

7. The control system of claim 5 wherein each of said control circuits includes a voltage comparator for comparing the respective signals with a reference voltage.

8. The control system of claim 5 wherein each of said switch devices is a triac.

9. The system of claim 8 wherein each of said triacs includes line, lead and gate elements, said line and lead elements of the damper triac being adapted to couple said damper closing means across a source of alternating current whereby a power failure de-energizes said damper closing means, said gate element of said damper triac being coupled to a source of reference potential, the damper control circuit having an output coupled to one of said line and load elements of said damper triac for applying a gating signal thereto; said line and load elements of the valve triac being adapted to couple said thermostat and said valve means serially across a source of alternating current whereby either removal of power or opening of said thermostat de-energizes said valve means, said gate element of said valve triac being coupled to said source of reference potential, the valve control circuit having an output coupled to one of said line and load elements of said valve triac for applying a gating signal thereto.

10. The system of claim 5 wherein gas sensing means includes a gas detector device having an output and a control circuit having an input connected to said output of said gas detector device, said gas detector control circuit having a gas-present signal output coupled to said damper and valve control circuits thereby respectively to de-energize said damper closing means and valve means in response to said gas-present signal.

11. The system of claim 10 wherein said gas detector control circuit includes a voltage comparator for comparing the output of said gas detector with a reference voltage.

12. The system of claim 5 further comprising first visual indicator means coupled to said timing means for providing a visual damper-open indication in response to said ON signal; second visual indicator means coupled to said timing means for providing a visual damper-closed indication in response to said time delay signal; and audible alarm means coupled to said gas presence sensing means for providing an audible alarm in response to said gas-present signal.

* * * * *